US006095432A

United States Patent [19]

Casagrande

[11] Patent Number: 6,095,432

[45] Date of Patent: Aug. 1, 2000

[54] IRRIGATOR CAPABLE OF ANGULAR MOVEMENT ABOUT AN AXIS OF ORIENTATION AND HAVING INTERCHANGEABLE NOZZLES

[76] Inventor: Antonio Casagrande, Via Torricella No. 18,50011 Antella, Bagno a, Ripoli, Florence, Italy

[21] Appl. No.: 08/875,483

[22] PCT Filed: Jan. 4, 1996

[86] PCT No.: PCT/IT96/00003

§ 371 Date: Jul. 10, 1997

§ 102(e) Date: Jul. 10, 1997

[87] PCT Pub. No.: WO96/21513

PCT Pub. Date: Jul. 18, 1996

[30] Foreign Application Priority Data

Jan. 11, 1995 [IT] Italy ..... FI95A0006

[51] Int. Cl.[7] ..... B05B 3/08

[52] U.S. Cl. ..... 239/230; 239/233; 239/600; 239/390

[58] Field of Search ..... 239/230, 231, 239/259, 660, 390, 393, DIG. 1

[56] References Cited

U.S. PATENT DOCUMENTS

| | | | |
|---|---|---|---|
| 3,580,508 | 5/1971 | Marandi et al. . | |
| 3,779,462 | 12/1973 | Bruninga . | |
| 3,871,582 | 3/1975 | Biddle . | |
| 3,874,588 | 4/1975 | Flynn | 239/230 X |
| 3,918,642 | 11/1975 | Best | 239/DIG. 1 |
| 3,924,809 | 12/1975 | Troup . | |
| 4,195,782 | 4/1980 | Troup | 239/230 |
| 4,216,913 | 8/1980 | Troup . | |
| 4,333,610 | 6/1982 | Clements . | |
| 4,350,298 | 9/1982 | Tada | 239/600 X |
| 4,365,758 | 12/1982 | Shaming | 239/600 X |
| 4,498,626 | 2/1985 | Pitchford | 234/230 |
| 4,538,763 | 9/1985 | Perry et al. | 239/600 |
| 4,566,632 | 1/1986 | Sesser . | |
| 4,721,248 | 1/1988 | Chow | 239/600 X |
| 4,794,995 | 1/1989 | Matson et al. | 239/600 X |
| 4,978,070 | 12/1990 | Chow | 239/230 |
| 5,090,621 | 2/1992 | McMillen et al. | 239/230 |
| 5,098,020 | 3/1992 | Cooper et al. | 239/230 |
| 5,234,169 | 8/1993 | McKenzie . | |

FOREIGN PATENT DOCUMENTS

| | | |
|---|---|---|
| 28 55 709 A1 | 8/1979 | Germany . |
| 2 138 704A | 10/1984 | United Kingdom . |

*Primary Examiner*—Kevin Weldon
*Attorney, Agent, or Firm*—McGlew and Tuttle, P.C.

[57] ABSTRACT

A fixed part and a mobile part. The mobile part includes a pipe head offering a curved path with an initial portion that commences axially and is deflected to form a final portion having a certain inclination. The inclined final portion is very short and forms a seat for an interchangeable nozzle selectable from a series of nozzles having tapering through orifices of different inclinations and all connectable to the deflection of the initial portion. Different inclination angles are thus possible.

12 Claims, 3 Drawing Sheets

55
34A
34B
57
54
35
55A
3A
5
56
52
51B
36
33
A
32E
7
74
74A
8
37
3
32A
17B
31
9B
9
17A
14
31A
1A
1
11
12

55A
55
54
51
51A
53
57
5
56
51B
52

3
36
34
35
34A
32B
33A
32C
34B
33
34A
33A
34B
34A
34B
35
35
III
III
34
33A
33
39
38
32C
32E
32B
36
37A
3
31
IV
37
31A
31B
32A
IV 7
74
73
A
74A
71
72

3
31A
31B
8
13
15
17B
17
17A
14

9B
9B
9A
9
1A
1
12
11

IRRIGATOR CAPABLE OF ANGULAR MOVEMENT ABOUT AN AXIS OF ORIENTATION AND HAVING INTERCHANGEABLE NOZZLES

This application Ser. No. 08/875483 is the National Stage of PCT/IT96/00003.

FIELD OF THE INVENTION

The invention relates to an irrigator capable of angular movement about an approximately vertical axis to cover an area requiring irrigation. The irrigator has been designed so as to be quick and simple to put together, and so that most of its components can easily be moulded, for example in synthetic resin. These and other objects and advantages will be clear from the following text.

SUMMARY AND OBJECTIVES OF THE INVENTION

The irrigator is of the type having a leaktight coupling between the fixed part and the mobile part, and a pipe head offering a curved path in which a portion that commences axially is deflected to form a final portion having a certain inclination. According to the invention said inclined final portion is very short and forms a seat for an interchangeable nozzle selectable from a series of nozzles having tapering through orifices of different inclinations and all connectable to said initial portion.

Said nozzles and their seat may have snapfitting forms, with guides to allow only one angular position of the nozzle when inserted into the seat. Said nozzles are advantageously made of a material offering elastic flexibility for easy insertion and removal.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

In some of the drawings the positions of parts of the components illustrated are altered for clarity.

DETAILED DESCRIPTION OF AN EMBODIMENT OF THE INVENTION

Figure 1:
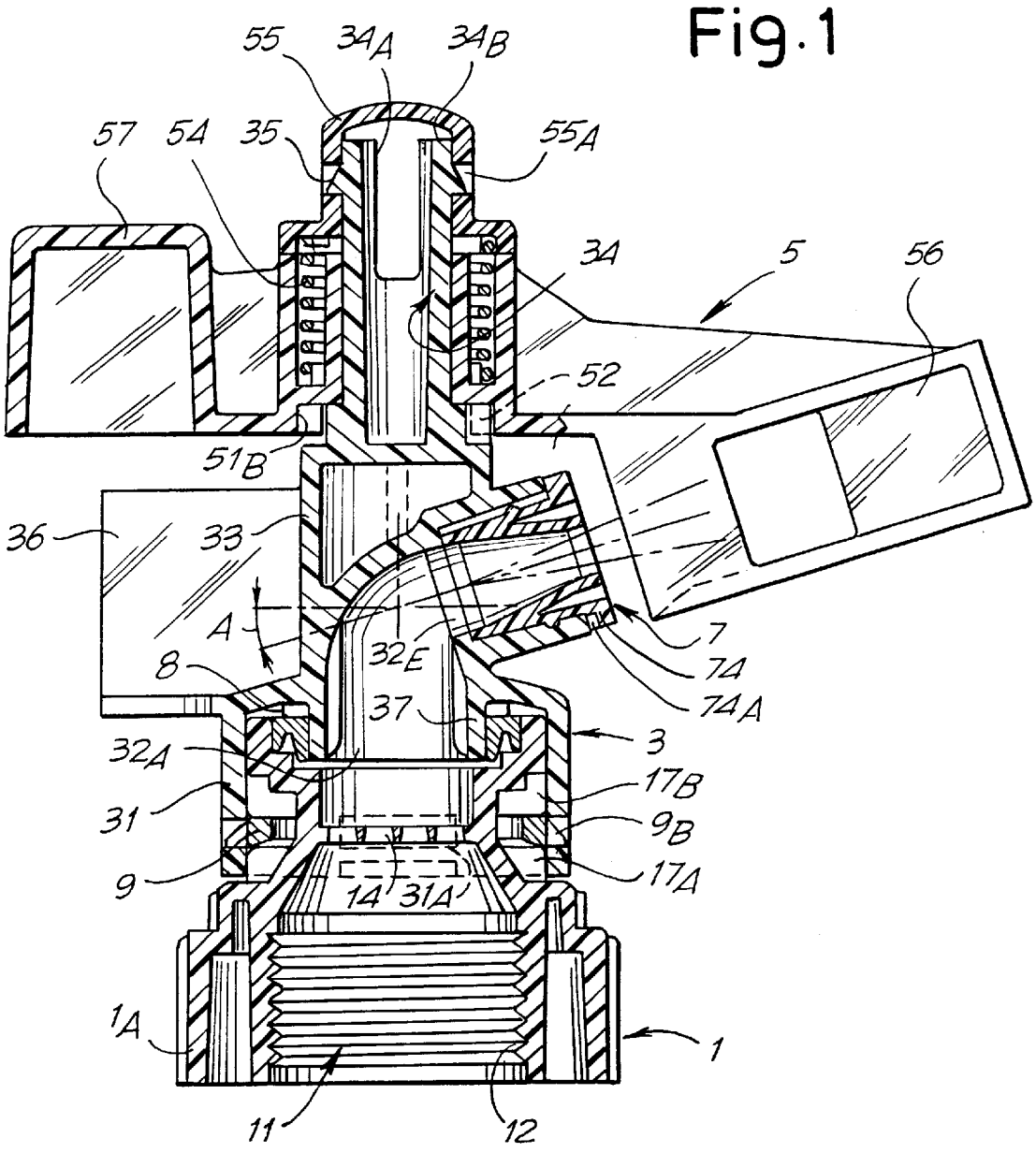
FIG. 1 shows a general axial section of the irrigator.
Figures 2, 3, 4, 5:
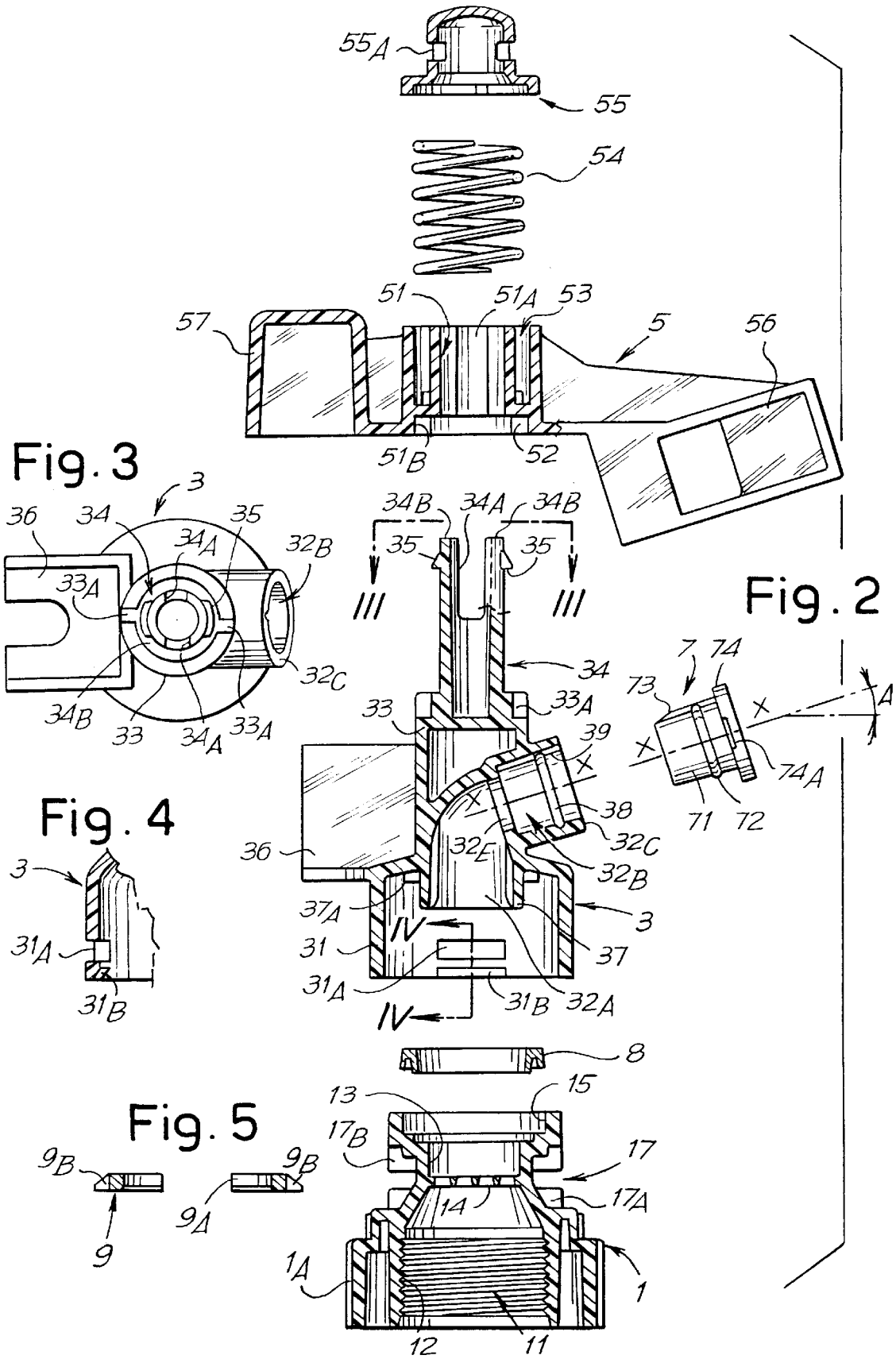
FIG. 2 shows an exploded view of the main components of the irrigator.
FIGS. 3 and 4 show a view on III—III and a local section on IV—IV as marked in FIG. 2.
FIG. 5 shows, separately, an elastic retaining ring component for locking together the fixed part and angularly mobile part while allowing angular movement.
Figure 6:
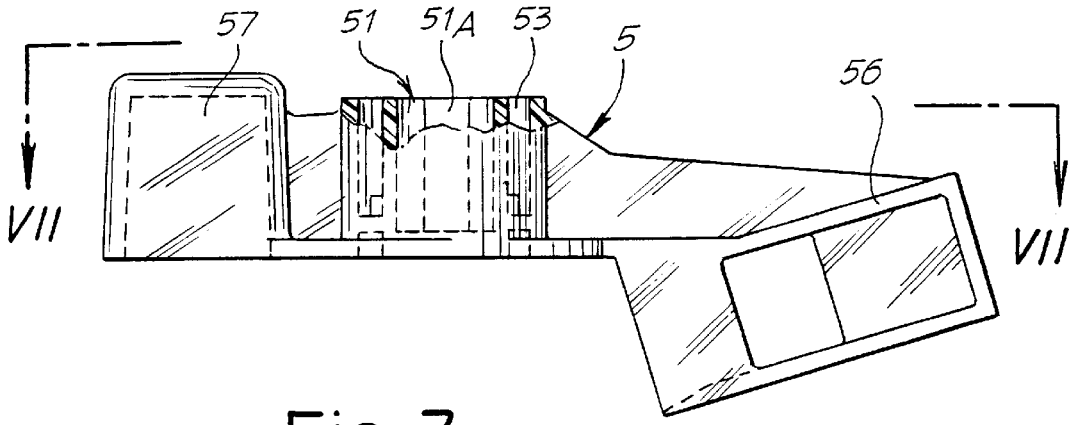
FIGS. 6 and 7 show in isolation, in side elevation and viewed from the line marked VII—VII in FIG. 6 the pivoting arm by which the jet of the nozzles is used to cause angular movement.
Figure 7:
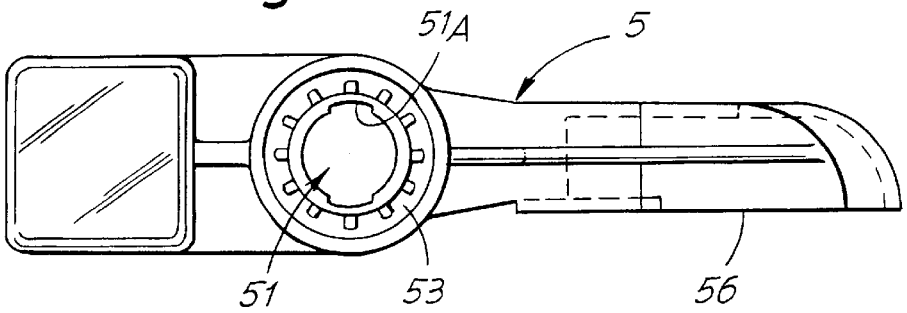

As illustrated in the accompanying drawing, 1 denotes the fixed part as a whole and 3 the mobile part. The function of the latter is to form a spray head inclined at a shallow angle to the horizontal and offering the possibility of producing jets of different inclinations in the manner indicated later; the mobile part 3 is actually that part which forms a deflecting bend. 5 denotes a pivoting arm which, in a manner known per se, causes the mobile part 3 to move angularly in successive and periodically reversed steps by using the energy supplied by the jet of irrigating liquid. In FIGS. 1 and 2, 7 denotes one of the nozzles that can be fitted into the mobile part 3.

The fixed part 1 comprises a large axial cavity 11 with an internal thread 12, while a skirt 1A is formed on the outside for handling purposes; the axial passage 11 includes a narrower intermediate portion 13 which may include a grid 14; above this is a final double step 15 which forms the seal seat for an axial seal 8 and allows relative movement between the fixed part 1 and the mobile part 3. Formed around the outside of the reduced-diameter portion 13 of the passage 11 is an external annular seat 17 for an elastic ring 9 open at 9A and forming two opposite teeth 9B that are triangular in shape or otherwise present an inclined guide surface for insertion. The external annular seat 17 of the part 1 may be defined by two series of lower 17A and upper 17B projections that define said seat and are intended to minimize the weight of the component 1 and reduce friction between the surface defining the annular seat 17 and the elastic retaining ring 9. The fixed part 1 is a component that can easily be moulded in, for example, synthetic resin, using a mould provided with masks and with a suitable number of laterally movable parts to enable rational orientation of the projections 17A and 17B. The gap 9A in the elastic retaining ring 9 is sufficiently large to ensure that, with a sufficiently small elastic deformation, it can be fitted transversely around the component 1 and accommodated and held in the annular seat 17 defined by the projections 17A and 17B, in such a way that its teeth 9B project somewhat from the external dimensions of said fixed part 1, for the purposes indicated later.

The mobile part 3 (see in particular FIGS. 2, 3 and 4) has at the bottom a bell 31 in the wall of which two diametrically opposite transverse through slots 31A are formed, their shape essentially corresponding to that of the rounded teeth 9B of the elastic retaining ring 9; underneath each of these through slots 31A is a rounding 31B on the bottom rim of the bell 31 designed to act on the inclined, that is rounded, teeth 9B of the ring 9 at the assembly stage. An initial portion 32A of a curved path commences in the interior of the bell and extends into a final portion 32B inclined at an angle A, which may be of around 17° relative to a plane perpendicular to the axis of the bell 31 and of the initial portion 32A of the curved path 32A, 32B; this portion 32B is very short and basically forms a seat for accommodating a nozzle 7, which will be described later. The component forming the mobile part 3 continues axially upwards above the curved path 32A, 32B of the pipe head, to form an axial coupling 33 from which there rises a pin 34, also axial; in the recess between the coupling 33 and the pin 34 there are two external stops 33A for the purposes indicated later. The pin 34 is axially hollow and slotted at 34A to define two opposite elastic fingers 34B, each of which has an elastic tooth 35 shaped for insertion i.e. rounded for the purposes indicated later. Formed on the outside of the component 3, on the side away from the inclined portion 32B of the passage forming the pipe head, is a box 36 for the return movement. The path formed by the portions 32A and 32B starts with a collar 37 that projects a short distance into the interior of the bell 31 so as to engage with the seal 8 housed in the seat 15 described above;

formed around the collar 37 are suitable projections 37A to hold the seal 8 in position, and this seal 8 itself is of a generally U-shaped section so as to fit the outward cylindrical surface (formed by the step 15) and inward cylindrical surface (formed by the collar 37). The seat 32B formed by the final portion of the path of the pipe head contains a shallow annular channel 38 and a longitudinal groove 39 for the purposes indicated later. In at least the initial portion 32A, the path contains suitable longitudinal ribs by way of guides to encourage the laminar flow of the liquid supplied under pressure to the irrigator to form the inclined jet which is thrown parabolically and with an angular movement about the axis of the irrigator, about which the mobile part 3 moves.

The pivoting arm 5 comprises a through seat 51 with longitudinal grooves 51A and with a lower enlargement 51B containing stops 52 The stops 52 are designed to interact with the stops 33A of the mobile part 3 by way of a suitable limitation on the angular excursion of which the pivoting arm 5 is capable relative to the mobile part 3. The through seat 51 is designed to accommodate the pin 34 and its longitudinal grooves 51A are designed to allow the elastic teeth 35 on the elastic fingers 34B formed by the pin 34 to be pushed through conveniently. It should be observed that in order to make the drawing simple to understand, the slots 34A, the elastic teeth 35 and the fingers 35B on the one hand and the longitudinal grooves 51A on the other are not depicted in the same positions in all the figures. Formed around the through seat 51 is a housing 53 of annular cross section for a helical spring 54, which is placed in the housing 53 and compressed between the bottom of this housing and a cap 55, which can be mounted on the end of the pin 34, using the elastic teeth 35 to engage in slots 55A in said cap 55. The pivoting arm 5 includes a blade 56 designed to be struck by the jet as it leaves the pipe head, while on the other side is an extension 57 in the form of an inverted box which serves to repeat the angular excursions imposed on the nozzle.

Figure 8:
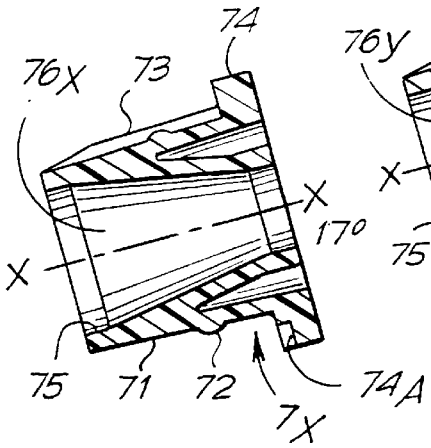
FIGS. 8, 9 and 10 show three possible examples of interchangeable nozzles in axial section.
Figure 9:
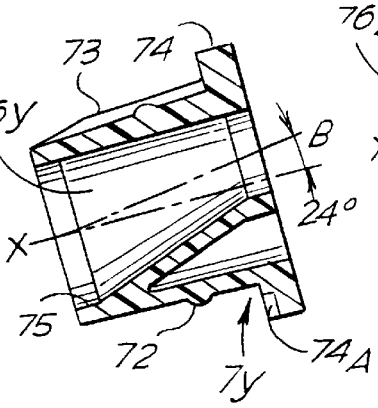
Figure 10:
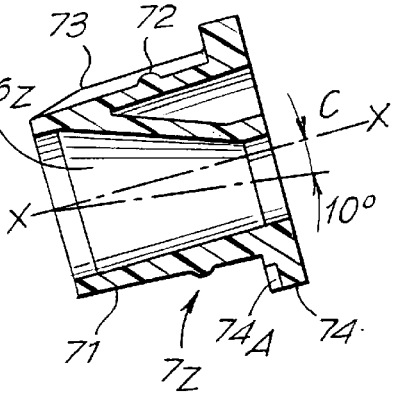

FIGS. 8, 9 and 10 illustrate three different nozzles that can be fitted into the seat 32B. Each of these nozzles, referred to generally by the numeral 7, has a surface 71 that mates with the surface of the seat 32B of the final portion of the path of the pipe head formed in the mobile part 3; on this surface 71 is an annular projection 72 which will fit into the annular channel 38 in the seat 32B; also on this surface 71 is a longitudinal rib 73 which will fit into the groove 39 formed in the seat 32B. Each of these nozzles 7 can thus be engaged in the seat 32B where the annular recess 38 holds them in place and the rib 73 combines with the longitudinal groove 39 to define their angular position. The nozzles 7 are all made from a synthetic resin having a certain elastic flexibility such that each nozzle is easy to insert into and extract from the seat 32B.

Each nozzle 7 is provided with a flange 74 that rests against the edge 32C of the pipe head formed by the mobile part 3; in this flange 74 is an indentation 74A, the presence of which facilitates the removal of a nozzle from its seat 32B. At the opposite end from the flange 74, each nozzle 7 has a mouth 75 which will correspond with the orifice 32E of the passage 32A, 32B at the bottom of the seat 32B. This mouth 75 is identical for all the nozzles and from it there extends a tapering through orifice 76, which differs for each nozzle shown in FIGS. 8, 9 and 10 in respect of the, inclination of the axis of said orifice relative to the axis X—X of the nozzle, in particular of the surface 71 that mates with the seat 32B. FIG. 8 shows a nozzle 7X in which the axis of the tapering through orifice 76X coincides with the axis X—X of the surface 71. FIG. 9 shows a nozzle 7Y whose tapering through orifice 76Y is inclined at an angle B relative to the axis X—X. The nozzle 7Z illustrated in FIG. 10 has a tapering through orifice 76Z inclined relative to the axis X—X of the surface 71 at an angle C opposite to the angle B of the nozzle 7Y shown in FIG. 9. The seat 32B is inclined by the angle A relative to a plane perpendicular to the main axis of the fixed and mobile parts 1 and 3. With this arrangement of the seat 32B and of the axes of the tapering through orifices 76X, 76Y and 76Z it is possible to obtain three different inclinations of the final jets produced by the irrigator, by using different nozzles.

The seal 8 is fitted into the seat formed by the step 15 while the elastic ring 9 is accommodated in the annular seat 17, into which it is introduced with a slight elastic deformation to enlarge the gap 9A. The bell 31 of the mobile part 3 is fitted over the top of the fixed part 1; in the process the bottom edge of the bell is pushed over the teeth 9B projecting from the ring 9, which retract because of the sliding action made possible by the roundings 31B before pushing out again—as the bell is pushed home—through the slits 31A in the wall of the bell thereby locking the member 3 on the member 1 in the axial direction while allowing rotation to take place when the ring 9 slides round inside the seat 17. Assembly causes the collar 37 of the initial part 32A of the curved passage of the pipe head to pass into the annular seal 8, thereby sealing the connection between the fixed part and the mobile part. The pivot arm 5 is fitted onto the pin 34 so that it rests on the recess formed by the coupling 33; in this way the stops 33A and 52 are brought together and engaged in such a way as to bring about the stepwise angular movements of the mobile part 3. The spring 54 is then inserted in the annular seat 53 and the cap 55 pushed over the end of the pin 34, making use of the elasticity of the extensions 34B and of the rounding of the teeth 35, which then engage in the slots 55A. This creates a torsion in the spring 54 and consequently axially stabilizes the pivoting arm 55, which is otherwise free to move within the limits imposed by the stops 33A and 52.

The irrigator is now completely assembled and ready to be screwed by means of its screw thread 12 onto the end of the pipe supplying the irrigating fluid. One of the nozzles 7 is inserted into the seat 32B, it being possible by this means to vary the outlet axis of the jet from the nozzle and hence the inclination of the jet of water. The axis of the jet as it leaves the nozzle can thus be inclined relative to a plane perpendicular to the axis of the components 1 and 3: by the angle A, when using nozzle 7X shown in FIG. 8; or by angle A+B when using nozzle 7Y shown in FIG. 9; or by angle A−C, when using nozzle 7Z shown in FIG. 10. Assuming the seat 32B to have an inclination, i.e. angle A, of 17°, the inclination that can be given to the jet when choosing one of the three nozzles 7X, 7Y and 7Z can be 17° or, for instance, 24° or 10°, depending on whether nozzle 7X or 7Y or 7Z is being used, respectively. By increasing the number of nozzles with inclinations different to the angles B and C shown in FIGS. 9 and 10, it is possible—and perfectly simple—to further vary the inclination of the jet of the irrigator, simply by inserting a different nozzle in the seat 32B.

A nozzle 7 can easily be removed from the seat 32 either by hand or by placing a tool between the edge 32C and the flange 74 in the indentation 74A. Dismantling the irrigator, when required, is immensely simplified because the cap 55 can be taken off simply by pressing in the teeth 35 through the slots 55A: this allows the spring to be withdrawn and the pivoting arm 5 taken off the pin 34. By pushing in the teeth 9B of the elastic ring 9 through the slots 31A it is also possible to detach the mobile part 3 from the fixed part 1.

The pin 34 may be formed by a component fitted onto the fixed part 3, e.g. connected to the coupling 33, the pin 34 being made in this case from a material having greater elasticity than can be obtained with the slots 34A in the pin 34 made integrally with the mobile part 3.

While specific embodiments of the invention have been shown and described in detail to illustrate the application of the principles of the invention, it will be understood that the invention may be embodied otherwise without departing from such principles.

I claim:

1. An irrigator angularly movable about an orientation axis, the irrigator comprising:

a fixed part;

a mobile part rotatably connected to said fixed part;

a curved pipe in said mobile part, said curved pipe having an first end substantially coaxial with the orientation axis and a second end being coaxial with a second end axis, said second end including a seat, said seat being coaxial with said second end axis, said second end axis being angularly spaced from the orientation axis;

a nozzle removably connectable to said second end of said curved pipe at an angularly fixed position with respect to said mobile part, said nozzle having an outer surface and an inner surface, said inner surface defining a tapering through duct with an input aperture and an output aperture, said duct being coaxial with a duct axis, said duct axis being angularly spaced from said second end axis;

a pivoting arm pivotally connected to said mobile part and positioned to be acted on by a jet expelled from said output aperture of said nozzle to bring about angular movements of said mobile part about the axis of orientation, a pivot axis of said pivoting arm substantially coincides with the orientation axis;

said mobile part includes a pin with elastic extensions having retaining teeth for retaining said pivoting arm on said mobile part;

a retaining cap is mounted on said pin after the pivoting arm, said retaining cap defines seats and said retaining cap is held in place by said retaining teeth which pass into said seats of said retaining cap;

a spring is housed between, and reacts between, said retaining cap and said pivoting arm said fixed part includes an annular seat;

said mobile part includes a bell that fits over and around the fixed part, said bell defines ring seats in a form of through slots;

an elastic retaining ring is fitted inside said bell and in said annular seat in said fixed part to provide axial locking between said fixed part and said mobile part, said retaining ring including teeth movable into said ring seats of said bell during assembly;

said seats of said retaining cap are formed by through slots;

said retaining teeth are movable into said seats of said retaining cap during assembly.

2. An irrigator in accordance with claim 1, wherein:

said nozzle is positionable on said mobile part at a plurality of said angular positions for varying said angular spacing between said duct axis and said second end axis.

3. An irrigator in accordance with claim 1, wherein:

said input aperture and said second end of said nozzle are in full communication with each other.

4. An irrigator in accordance with claim 1, wherein:

said nozzle defines only a single said duct.

5. An irrigator in accordance with claim 1, wherein:

said input aperture and said seat are of a substantially same size and are substantially aligned.

6. An irrigator in accordance with claim 1, wherein:

a center of said seat is aligned with a center of said input aperture.

7. An irrigator in accordance with claim 1, wherein:

said inner surface has a first portion angularly spaced from said second end axis by a first angle.

8. An irrigator in accordance with claim 1, wherein:

said input aperture and said second end of said nozzle are in full communication with each other, said input aperture and said seat are of a substantially same size and are substantially aligned;

said nozzle defines only a single said duct;

said inner surface has a first portion angularly spaced from said second end axis by a first angle, said inner surface has a second portion angularly spaced from said second end axis by a second angle, said first and second angles are different.

9. An irrigator in accordance with claim 1, wherein:

said nozzle and said seat include snap-fitting forms with guides for connecting said nozzle to said mobile part at only one said angular position.

10. An irrigator in accordance with claim 9, wherein:

said nozzle is formed of a material with elastic flexibility for insertion and removal.

11. An irrigator angularly movable about an orientation axis, the irrigator comprising:

a fixed part with a seal seat and an annular seat;

a mobile part rotatably connected to said fixed part, said mobile part includes a bell that fits over and around the fixed part;

a seal housed in said seal seat on said fixed part and held in place by said bell;

an elastic retaining ring fitted inside said bell and in said annular seat in said fixed part to provide axial locking between said fixed part and said mobile part;

a curved pipe in said mobile part, said curved pipe having a first end substantially coaxial with the orientation axis and a second end being coaxial with a second end axis, said second end defining a seat, said seat being coaxial with said second end axis, said second end axis being angularly spaced from the orientation axis;

a nozzle removably connectable to said second end of said curved pipe at an angularly fixed position with respect to said mobile part, said nozzle having an outer surface and an inner surface, said inner surface defining a tapering through duct with an input aperture and an output aperture, said duct being coaxial with a duct axis, said duct axis being angularly spaced from said second end axis.

12. An irrigation kit angularly movable about an orientation axis, the irrigation kit comprising:

a fixed part;

a mobile part rotatably connected to said fixed part;

a curved pipe in said mobile part, said curved pipe having an first end substantially coaxial with the orientation axis and a second end being coaxial with a second end axis, said second end defining a seat, said seat being coaxial with said second end axis, said second end axis being angularly spaced from said orientation axis;

a plurality of nozzles removably connectable to said second end of said curved pipe at an angularly fixed position with respect to said mobile part, said plurality of nozzles having an outer surface and an inner surface, said inner surface defining a tapering through duct with an input aperture and an output aperture, said duct being coaxial with a duct axis, said duct axis of each of said nozzles being angularly spaced by different amounts from said second end axis.

* * * * *